US005137462A

United States Patent [19]

Casey et al.

[11] Patent Number: 5,137,462

[45] Date of Patent: Aug. 11, 1992

[54] ADAPTER FOR STACKING CONNECTOR ASSEMBLY

[75] Inventors: Daniel T. Casey, Harrisburg; Lahman D. Lambert, II, Carlisle, both of Pa.

[73] Assignee: AMP Incorporated, Harrisburg, Pa.

[21] Appl. No.: 744,135

[22] Filed: Aug. 13, 1991

[51] Int. Cl.[5] ..... H01R 9/09; H01R 13/62; H01R 13/64

[52] U.S. Cl. ..... 439/74; 439/248; 439/374; 439/650; 439/160

[58] Field of Search ..... 439/74-76, 439/64, 153, 159, 160, 246-248, 262, 374, 525, 640, 650

[56] References Cited

U.S. PATENT DOCUMENTS

| | | | |
|---|---|---|---|
| 4,579,408 | 4/1986 | Sasaki | 439/374 |
| 4,684,187 | 8/1987 | Rudy, Jr. et al. | 439/600 |
| 4,686,333 | 8/1987 | Hoffman et al. | 200/6 B |
| 4,871,320 | 10/1989 | Mouissie | 439/78 |
| 4,909,746 | 3/1990 | Scholz | 439/82 |
| 4,944,693 | 7/1990 | Puerner | 439/358 |
| 4,993,965 | 2/1991 | Eck | 439/248 |

FOREIGN PATENT DOCUMENTS

| | | | |
|---|---|---|---|
| 3736025 | 12/1988 | Fed. Rep. of Germany | 439/74 |

OTHER PUBLICATIONS

AMP Catalog No. 87-800 "AMPMODU System 50 Connectors", pp. 3,4,8,13-18; Oct. 1987; AMP Incorporated, Harrisburg, Pa.

AMP Customer Drawing No. 533650 "Receptacle Connector with 0.250 Long Action Pin Post, 2-Row" Sheets 1&2, ('86 Rev. Feb. 1989), AMP Incorporated, Harrisburg, Pa.

*Primary Examiner*—Paula A. Bradley

*Attorney, Agent, or Firm*—Anton P. Ness

[57] ABSTRACT

An adapter for interconnecting receptacle contact sections of opposing connectors includes a housing and a plurality of contacts contained therein and having first and second pin contact sections extending in first and second arrays from first and second mating faces of the adapter matable with the receptacle contact sections of the connectors. A pair of side walls extend along two opposing sides of the first array to leading edges, and a plurality of latching ledges extend inwardly from the leading edges to latch behind corresponding latching surfaces along outer surfaces of one of the connectors, while being matable with the other connector without latching thereto, facilitating disassembly, all without requiring modification to the connectors. The side walls deflect outwardly as the latching ledges pass over side surfaces of the one connector until latched. The adapter is useful in interconnecting two circuit boards stacked in parallel a fixed distance apart, where the connectors are mounted to the boards, in a manner permitting disassembly of the boards.

9 Claims, 5 Drawing Sheets

ADAPTER FOR STACKING CONNECTOR ASSEMBLY

FIELD OF THE INVENTION

The present invention relates to the field of electrical connectors and more particularly for connectors interconnecting circuit boards.

BACKGROUND OF THE INVENTION

In certain arrangements it is desired to electrically interconnect circuits of two circuit boards which are arrayed parallel to each other within an assembly, and in a manner which permits the boards to be separated if desired. Connectors are known in which an array of contacts have post contact sections extending from a mounting face of the housing for insertion through and beyond through-holes of a first circuit board and soldering to conductive trace portions of the board adjacent the through-holes, and have receptacle or socket contact sections exposed along an opposed mating face of the housing to receive associated post contact sections of a like connector mounted to a second circuit board; a shroud may be mounted to the second board to surround and protect the array of post contact sections extending therefrom, while being adapted to matably receive the connector housing thereinto. Such connectors are termed "stacking connectors" and one particular example of such a stacking connector is disclosed in U.S. Pat. No. 4,909,746. One type of stackable connector is sold by AMP Incorporated, Harrisburg, Pa. under Part No. 533650.

It is desirable to provide an adapter to interconnect opposing connectors of existing design having receptacle contact sections and having like mating interfaces, without requiring modification of the connectors.

It is also desirable to provide such an adapter to also space apart the mating interfaces of such connectors a distance equal to their spacing when mounted to opposing circuit boards in an assembly wherein the board-to-board spacing is a limited predetermined distance.

SUMMARY OF THE INVENTION

The present invention is an adapter matable with and between a pair of electrical connectors of a certain two-row conventional configuration in which at least one of the connectors includes a plurality of apertures extending through side walls of the housing to receive retention lances of respective contacts, each connector being mounted to a respective circuit board and opposing each other when the boards are oriented to be stacked in a parallel assembly. The adapter comprises a housing of resilient dielectric material and includes an array of contacts secured therein having pin contact sections extending from opposed mating faces thereof to mate with corresponding receptacle contact sections of the electrical connectors. The adapter includes opposing walls effectively defining a shroud extending forwardly from one of the mating faces to surround the array of pin contact sections extending therefrom. Latching ledges extend inwardly from the inside surfaces of the opposing walls at a plurality of locations just inwardly of their leading ends, which correspond to selected ones of the preexisting apertures of the connector housing. When the adapter is mounted over the connector, the opposing side walls coextend alongside the connector side walls and are deflected outwardly as the latching ledges bear against the connector side walls until the ledges enter respective ones of the apertures and latchingly engage therein, as the pin contact sections of the first array mate with corresponding receptacle contacts of the connector.

The pin contact sections of the second array extend upwardly for mating with receptacle contacts of the second connector when the second board is being stacked and interconnected with the first board. Optionally, a pair of alignment posts extend farther upwardly than the pin contact sections, to enter alignment apertures of the second connector as the second board is being stacked, to align the second connector with the first, thus protecting the second pin array from damage during board manipulation for assembly and interconnection.

In one embodiment, the adapter includes a pair of integrally formed wings extend outwardly and upwardly from bases of the opposing side walls. When free ends of the wings are manually gripped and urged toward each other, the opposing side walls are rotated slightly outwardly thus freeing the latching ledges from latched engagement within the apertures of the first connector housing allowing removal of the adapter from the first connector for repair and servicing or replacement without requiring tools and also without requiring access to the latched end of the adapter which commonly is adjacent to other electrical components which would inhibit such access.

It is an objective of the present invention to provide an adapter for interconnecting opposing connectors having arrays of receptacle contacts, with the contacts of one of the connectors latchingly held in passageways by retention lances engaged in apertures through side walls of that connector, so that the adapter remains secured to one of the connectors without requiring modification of the connector, while remaining unsecured and easily unmatable from the other connector.

It is an additional objective for such an adapter to interconnect parallel circuit boards stacked in a framework a given distance apart, by extending a distance between connectors previously secured to such boards prior to stacking, in a manner which permits the boards to be disassembled from one another without delatching or uncoupling at the interconnection.

Embodiments of the adapter of the present invention will now be described by way of example with reference to the accompanying drawings.

DETAILED DESCRIPTION OF THE PREFERRED EMBODIMENTS

Figure 1:
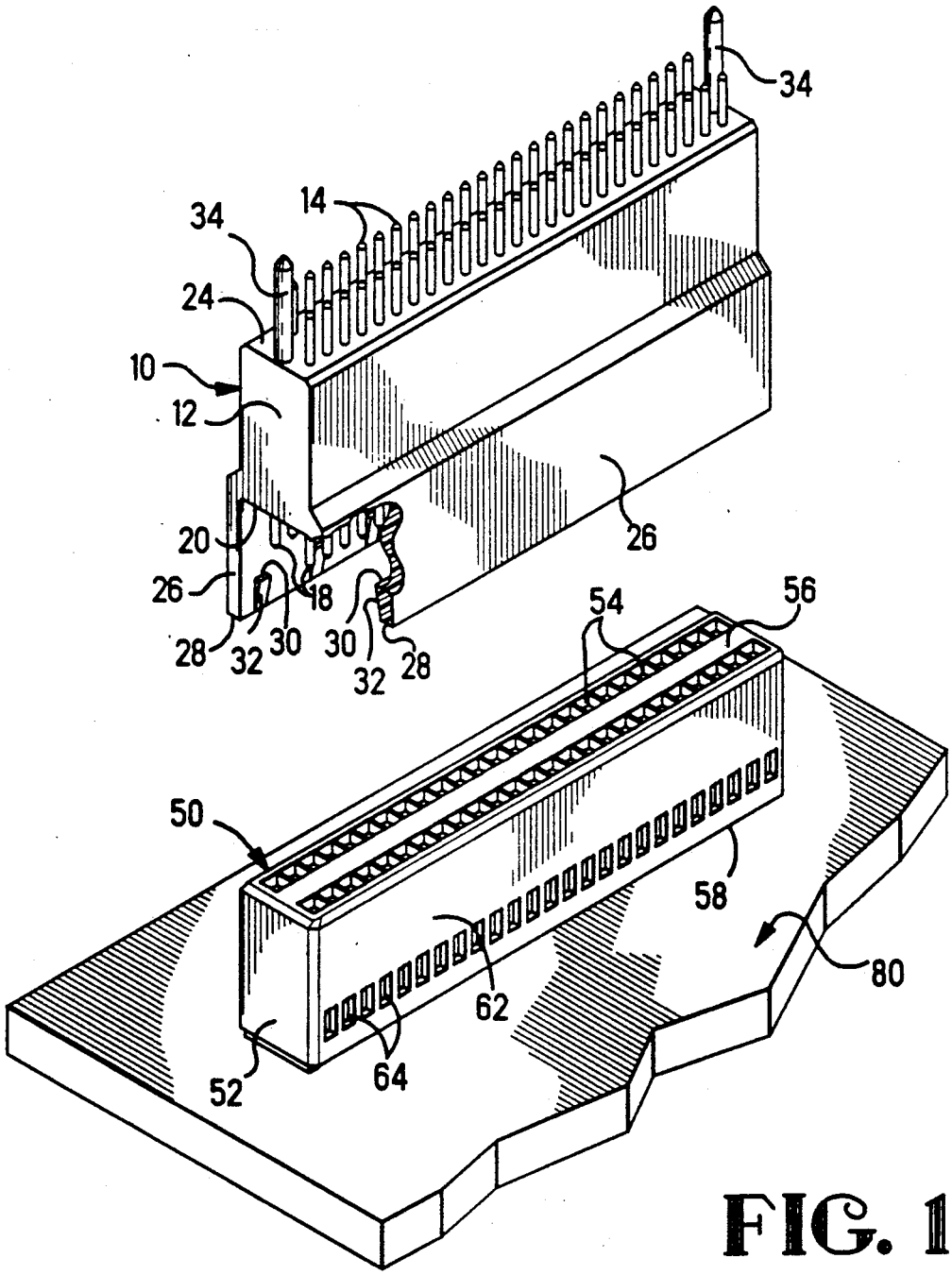
FIG. 1 is an isometric view of the adapter of the present invention exploded from the prior art connector with which it mates.

In FIGS. 1 to 5 a connector 50 of existing design includes a housing 52 having a plurality of passageways 54 extending from mating face 56 to mounting face 58 within which are respective contacts 60. Extending transversely through side walls 62 of housing 52 are apertures 64 in communication with respective passageways 54, and contacts 60 are of the type having retention lances 66 which latch within respective apertures 64 to hold the contacts within the housing after insertion into passageways 54 from mounting face 58. Connector 50 is shown already mounted to a circuit board 80 along mounting face 58, with post contact sections 68 of contacts 64 extending through through-holes 82 soldered or otherwise electrically connected with conductive traces of the circuit board. Receptacle contact sections 70 are exposed along mating face 56 to receive thereinto and mate with pins of a mating connector (not shown). Such a connector 50 is of the type sold by AMP Incorporated, Harrisburg, Pa. under the designation AMPMODU System 50, Part No. 104078-5 (trademark of AMP Incorporated).

Figure 2:
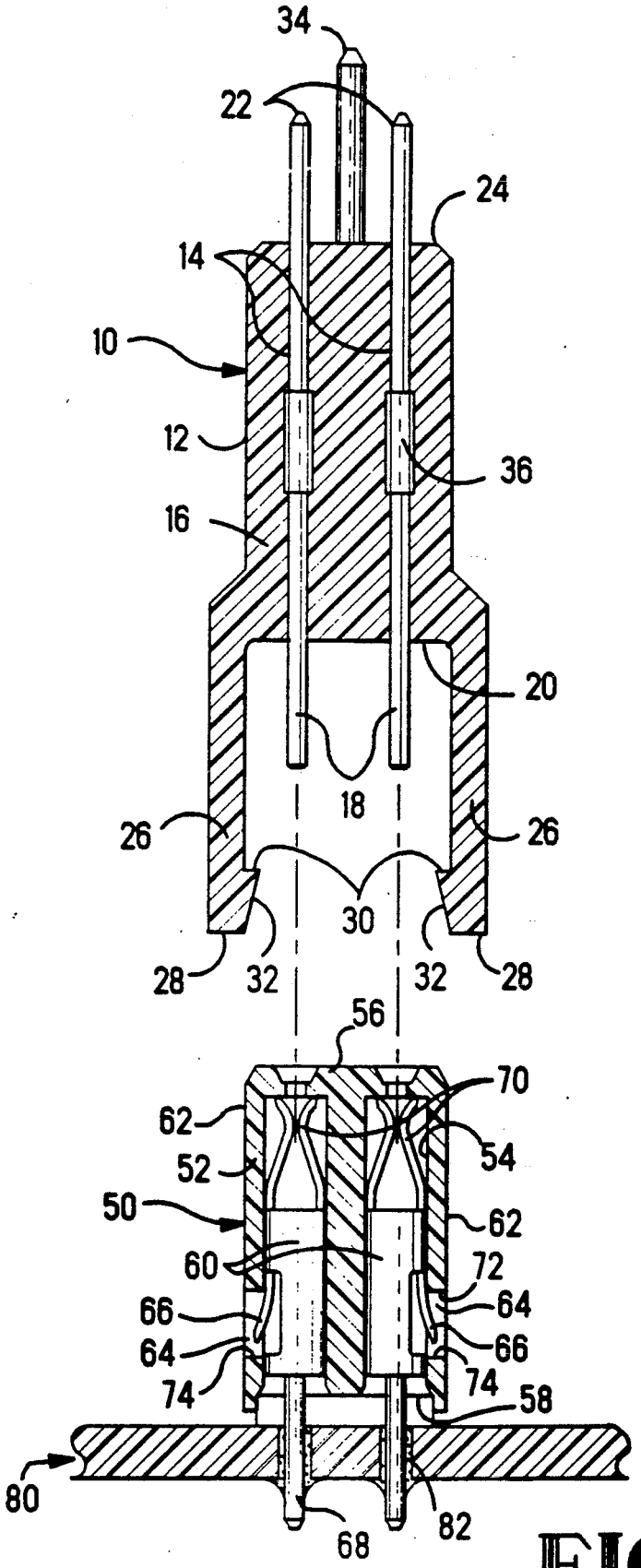
FIGS. 2 and 3 are longitudinal section views of the adapter and connector of FIG. 1 prior to mating and latched upon mating respectively.
Figure 3:
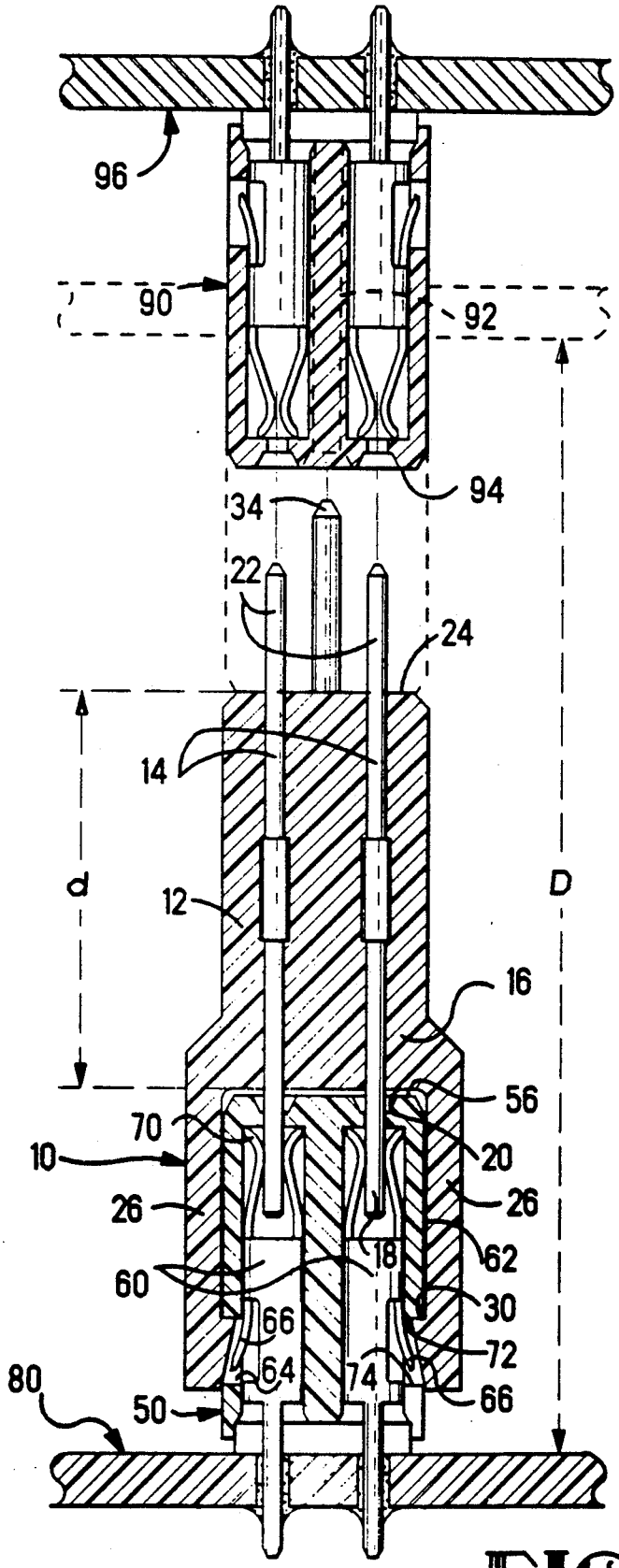

Adapter 10 in FIGS. 1 to 3 includes a housing 12 and a plurality of contacts 14 retained in a body section 16 thereof. Contacts 14 include first pin contact sections 18 extending from a first mating face 20 in a first array, and second pin contact sections 22 extending outwardly from a second mating face 24 in a second array, each array matable with corresponding arrays of receptacle contact sections of mating connectors. Opposing side walls 26 extend to leading edges 28 from first mating face 20 along sides of the first array of pin contact sections 18 to generally define a shroud. Latching ledges 30 are defined at spaced locations along inside surfaces of opposing side walls 26 proximate leading edges 28, and gently tapered bearing surfaces 32 lead thereto from leading edges 28. Latching ledges 30 are located to correspond with selected ones of apertures 64 of connector 50. It is preferred that a pair of alignment posts 34 extend upwardly from second mating face 24 to facilitate alignment of a second connector (FIG. 3) during mating, by cooperating with alignment apertures extending into the mating face of the second connector, as is conventional.

Each adapter 10 is preferably formed by molding appropriate plastic resin about flanged body sections 36 of contacts 14 to assure retention and prevent axial movement of the contacts during handling and mating and unmating, the resin being selected to provide resilience to the molded housing 12. Such a resin may be for example, glass-filled polyester such as VALOX 420 (trademark of General Electric Co.). Referring to FIGS. 2 and 3, adapter 10 is being mated with connector 50 by being inserted thereover. After initial engagement of tapered bearing surfaces 32 of latching ledges 30 with leading ends of side surfaces 62 of connector 50, side walls 26 of adapter 10 are deflected slightly outwardly as latching ledges 30 ride over side walls 62 of connector 50 until ledges 30 align laterally with respective apertures 64 of the connector whereafter latching ledges 30 enter apertures 64 and latch behind downwardly facing aperture edges 72, and adapter side walls 26 resile to rest along and adjacent to side walls 62 of connector 50. With latching ledges 30 utilizing the downwardly facing aperture edges 72, there is no interference with the retention lances 66 of contacts 60 of connector 50, which utilize the upwardly facing aperture edges 74.

With adapter 10 secured in place mated to connector 50, the assembly is prepared to mate with a second connector such as one identical to connector 50, along the second array of second pin contact sections 22 along second mating face 24 of adapter 10. Such a second connector 90 would include alignment apertures 92 (in phantom) entering mating face 94 at opposite ends thereof and connector 90 could be previously secured to a second circuit board 96, all as seen in FIG. 3. Since it would be desirable to disassemble second board 94 from first board 80 from time to time, it is preferable not to latch second connector 90 to adapter 10 since delatching would be extraordinarily difficult as the parallel boards would effectively prohibit access to the connector assembly for manipulation or tool-assisted disengagement. Instead, parallel board assemblies are secured together by framework or other fastening means (not shown) at at least two locations about the periphery of the boards.

As indicated is phantom, boards 80,96 are spaced apart a distance D upon full assembly such as would be determined by framework (not shown) in which the boards are contained in an apparatus; the connector mating faces 56,94 would be a distance d apart, dependent on distance D. Adapter 10 must interconnect connectors 50,90 over distance d.

Figure 4:
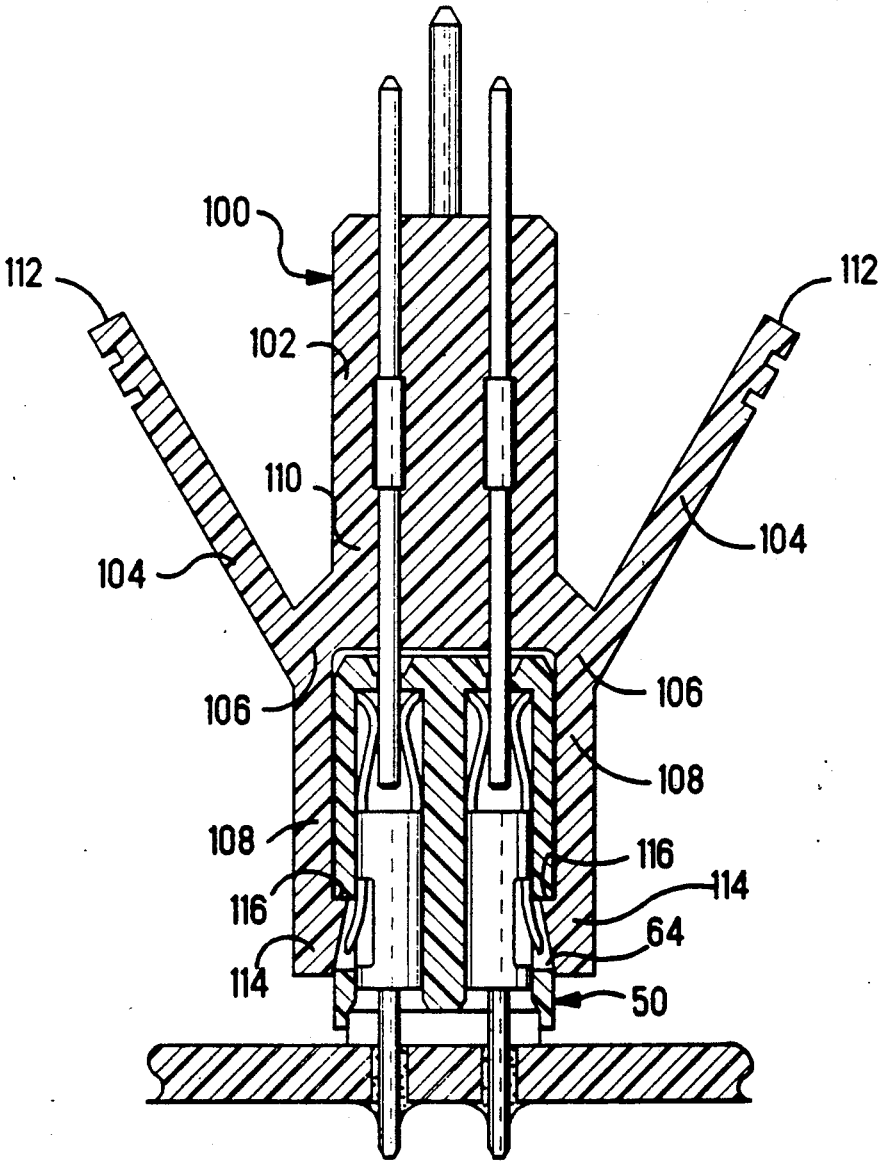
FIGS. 4 and 5 are longitudinal section views of another embodiment of the present invention mated with the prior art connector and being delatched during disassembly respectively.
Figure 5:
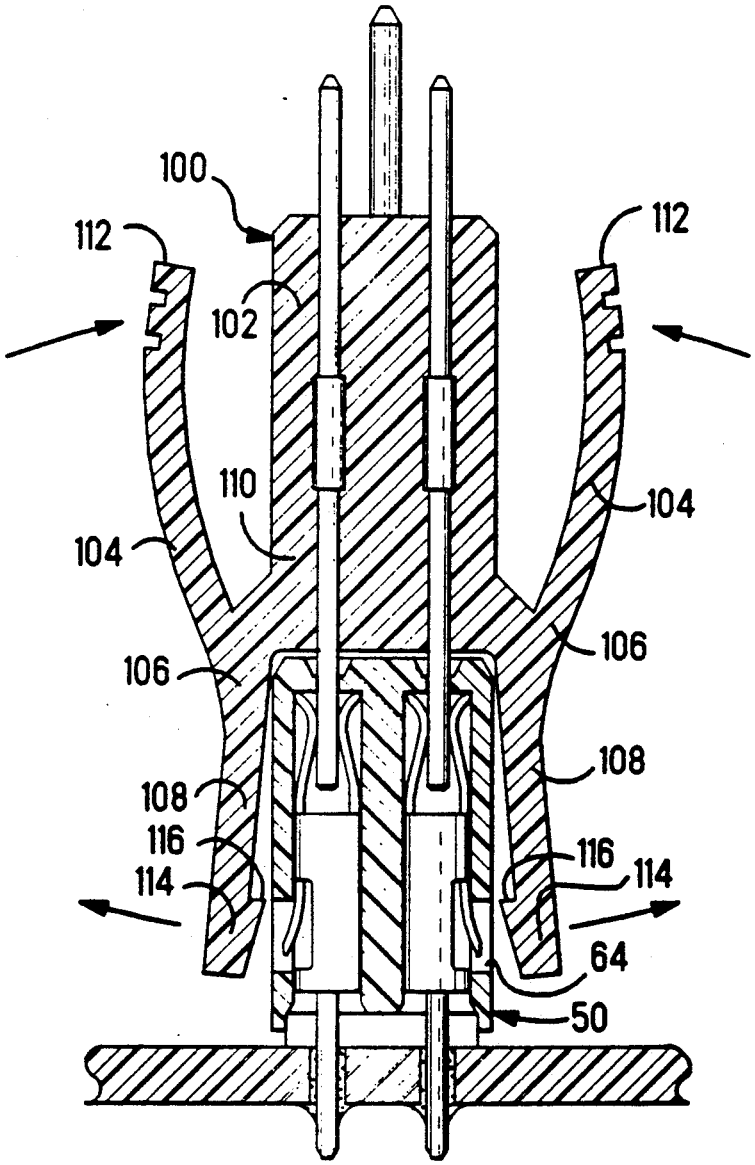

Another embodiment of adapter is illustrated in FIGS. 4 and 5, wherein adapter 100 includes means to facilitate disengagement and removal from first connector 50. Housing 102 includes wings 104 extending from joints 106 at the base of side walls 108 adjacent body section 110. Wings 104 extend upwardly and outwardly at an angle such as about 30° or so, to free ends 112 which provide a means for being manually gripped and urged together toward housing 102. By reason of being joined to housing 102 at bases of side walls 108, the inward deflection of wings 104 transmits torque to side walls 108 tending to rotate them slightly outwardly, sufficient to pivot leading ends 114 outwardly and translate latching ledges 116 thereon outwardly from apertures 64 of connector 50 and thus delatch adapter 100 from connector 50 permitting removal therefrom.

Modifications to the specific examples disclosed herein may occur which are within the spirit of the invention and the scope of the claims. For example, it may be desired to provide for manual alignment of the adapter with the second connector, in which case alignment posts would not be provided on the adapter. Also, the adapter may be used with a first connector having other features to which the latching ledges may latchingly engage, such as a continuous ledge along the connector side walls rather than require a plurality of apertures.

What is claimed is:

1. An adapter for interconnecting opposing electrical connectors containing receptacle contact sections across the respective mating faces in opposing like arrays to be electrically interconnected, comprising:

a housing of resilient dielectric material and including a body section in which are secured body sections of a plurality of contacts extending therethrough from a first mating face to a second mating face, said housing including a pair of opposing side walls extending from said first mating face and along two opposing sides of a first array of first pin contact sections of said pin contacts to leading edges spaced forwardly of leading ends of said pin contact sections, and said side walls each including an array of latching ledges spaced therealong adjacent said leading edges and extending inwardly from inside surfaces of said side walls, and said contacts including a second array of second pin contact sections extending from said second mating face, defining an adapter, whereby said adapter is securable to a first electrical connector in mated relationship when moved axially theretowards so that said latching ledges initially bear against side surfaces of said first connector and are deflected outwardly until said latching ledges ride beyond corresponding latching surfaces of said side surfaces of said connector whereafter said side walls resile and said latching ledges latch with said corresponding latching surfaces, and said second array of second pin contact sections is exposed along said second mating face to be mated with a second electrical connector.

2. An adapter as set forth in claim 1 wherein said housing includes a pair of wings extending at an angle outwardly and away from said first mating face to respective free ends spaced laterally from sides of said housing, each said wing joined integrally to the base of a respective said side wall, whereby deflection of said free ends of said wings toward said housing rotates said side walls away from said side surfaces of said first connector and translating said latching ledges outwardly from latching engagement with said corresponding latching surfaces of said first connector, enabling release of said adapter from said first connector.

3. An adapter as set forth in claim 1 wherein said latching ledges are positioned and adapted to correspond with and latchingly engage within apertures of side surfaces of said first connector.

4. An adapter as set forth in claim 3 wherein said housing includes a pair of wings extending at an angle outwardly and away from said first mating face to respective free ends spaced laterally from sides of said housing, each said wing joined integrally to the base of a respective said side wall, whereby deflection of said free ends of said wings toward said housing rotates said side walls away from said side surfaces of said first connector and translating said latching ledges outwardly from latching engagement with said corresponding latching surfaces of said first connector, enabling release of said adapter from said first connector.

5. An assembly for interconnecting associated electrical circuits of first and second circuit boards disposed parallel to each other a selected distance apart in a stacked assembly, comprising:

a first connector mounted to said first circuit board and having first contacts electrically connected to circuits thereof and having an array of receptacle contact sections exposed along a mating face of said first connector;

a second connector mounted to said second circuit board and having second contacts electrically connected to circuits thereof and having an array of receptacle contact sections exposed along a mating face of said second connector opposed from said array of receptacle contact sections of said first connector when said circuit boards are aligned with each other to be stacked; and an adapter including a housing of resilient dielectric material including a body section in which are secured body sections of a plurality of contacts extending therethrough from a first mating face to a second mating face, said housing including a pair of opposing side walls extending from said first mating face and along two opposing sides of a first array of first pin contact sections of said pin contacts to leading edges spaced forwardly of leading ends of said pin contact sections, and said side walls each including an array of latching ledges spaced therealong adjacent said leading edges and extending inwardly from inside surfaces of said side walls, and said contacts including a second array of second pin contact sections extending from said second mating face, whereby said adapter is securable to said first electrical connector in mated relationship when moved axially theretowards so that said latching ledges initially bear against side surfaces of said first connector and are deflected outwardly until said latching ledges ride beyond corresponding latching surfaces of said side surfaces of said first connector whereafter said side walls resile and said latching ledges latch with said corresponding latching surfaces, and said second array of second pin contact sections is exposed along said second mating face to be mated with said second electrical connector when said second circuit board is stacked in assembly with said first circuit board.

6. An assembly as set forth in claim 5 wherein said second circuit board is securable at a selected distance from said first circuit board thereby defining a preselected board-to-board spacing and said opposing mating interfaces of said first and second connectors mounted to said first and second circuit boards necessarily define a connector-to-connector spacing resulting from said board-to-board spacing, and said body section of said adapter has a length between said first and second mating faces equal to said connector-to-connector spacing.

7. An adapter as set forth in claim 5 wherein said housing includes a pair of wings extending at an angle outwardly and away from said first mating face to respective free ends spaced laterally from sides of said housing, each said wing joined integrally to the base of a respective said side wall, whereby deflection of said free ends of said wings toward said housing rotates said side walls away from said side surfaces of said first connector and translating said latching ledges outwardly from latching engagement with said corresponding latching surfaces of said first connector, enabling release of said adapter from said first connector.

8. An adapter as set forth in claim 7 wherein said latching ledges are positioned and adapted to correspond with and latchingly engage within apertures of side surfaces of said first connector.

9. An adapter for interconnecting opposing electrical connectors containing receptacle contact sections across the respective mating faces in opposing like arrays to be electrically interconnected, comprising:

a housing of resilient dielectric material and including a body section in which are secured body sections of a plurality of contacts extending therethrough from a first mating face to a second mating face, said housing including a pair of opposing side walls extending from said first mating face and along two opposing sides of a first array of first pin contact sections of said pin contacts to leading edges spaced forwardly of leading ends of said pin contact sections;

said side walls each including an array of latching ledges spaced therealong adjacent said leading edges and extending inwardly from inside surfaces of said side walls, and said contacts including a second array of second pin contact sections extending from said second mating face; and said housing including a pair of wings extending at an angle outwardly and away from said first mating face to respective free ends spaced laterally from sides of said housing, each said wing joined integrally to the base of a respective said side wall, defining an adapter, whereby said adapter is securable to a first electrical connector in mated relationship when moved axially theretowards so that said latching ledges initially bear against side surfaces of said first connector and are deflected outwardly until said latching ledges ride beyond corresponding latching surfaces of said side surfaces of said connector whereafter said side walls resile and said latching ledges latch with said corresponding latching surfaces and deflection of said free ends of said wings toward said housing rotates said side walls away from said side surfaces of said first connector and translating said latching ledges outwardly from latching engagement with said corresponding latching surfaces of said first connector, enabling release of said adapter from said first connector, and said second array of second pin contact sections is exposed along said second mating face to be mated with a second electrical connector with said wings permitting mating with said second electrical connector.

* * * * *